United States Patent [19]

King

[11] 4,337,602

[45] Jul. 6, 1982

[54] ENCLOSURE

[76] Inventor: Richard P. King, 7 Orange Ct., Wappingers Falls, N.Y. 12590

[21] Appl. No.: 141,633

[22] Filed: Apr. 18, 1980

[51] Int. Cl.[3] ..... E06B 6/26

[52] U.S. Cl. ..... 52/202; 182/46; 182/81

[58] Field of Search ..... 52/202; 182/81, 77, 182/46, 47; 160/DIG. 18, 354, 368 R

[56] References Cited

U.S. PATENT DOCUMENTS

| | | | |
|---|---|---|---|
| 2,321,499 | 6/1943 | Marschke | 182/81 |
| 2,391,871 | 1/1946 | Benson | 160/368 |
| 3,251,399 | 5/1966 | Grossman | 160/180 |
| 4,109,484 | 8/1978 | Cunningham | 62/256 |
| 4,122,887 | 10/1978 | Dussault et al. | 160/354 |
| 4,151,894 | 5/1979 | Edwards | 182/46 |

*Primary Examiner*—Carl D. Friedman

*Attorney, Agent, or Firm*—John Maier, III

[57] ABSTRACT

An enclosure for preventing the loss of heat and moisture through a ceiling entrance. The enclosure includes a flexible envelope with a fastening means to permit ingress and egress through the ceiling entrance while insulating the ceiling with a dead air space when the entrance is closed.

6 Claims, 2 Drawing Figures

ENCLOSURE

BACKGROUND OF THE INVENTION

This invention pertains to an enclosure and more particular to a thermal and moisture barrier enclosure for insulating a ceiling entrance to prevent the loss of heat and moisture through the ceiling entrance.

With the ever increasing cost of energy, many building owners, and in particular home owners, have insulated their buildings to prevent the loss of heat. Insulation in various forms is readily available along with storm windows and doors. In homes and other buildings there often is a ceiling entrance. In many homes, this is the only entrance for entering the attic crawl space. The floors of such attics, which is usually the ceiling of the second floor, is most always insulated. A retractable staircase which folds up above the ceiling door is often used to reach the attic area. Although the entire ceiling is insulated, this doorway cannot be insulated in the same manner as the ceiling and such an entrance permits a substantial amount of heat and moisture to be lost from the building.

As disclosed herein, such a loss of heat and moisture is substantially reduced while still providing a ceiling entrance which can be readily used to enter the unheated crawl space of the building.

Although various enclosures have been provided for entrances, no enclosure for use with a ceiling entrance is known.

SUMMARY OF THE INVENTION AND OBJECTS

The present invention provides an enclosure for insulating a ceiling entrance by utilizing a preferably flexible envelope supported on a few vertical posts. The envelope is preferably rectangularly shaped and has a fastener, such as a zipper, located about two of its two major sides and one minor side to permit it being opened and folded back on the other minor side. When the envelope is so folded back, the ceiling entrance can be readily used as if the envelope were not there. Slats are placed around the lower edge of the envelope where the lower edge joins the frame of the entrance to seal the enclosure.

The novel features which are considered as characteristic of the invention are set forth with particularity in the appended claims.

The invention itself, however, as to its construction and obvious advantages will be best understood from the following description of the specific embodiment when read with the accompanying drawings.

DETAILED DESCRIPTION OF THE PREFERRED EMBODIMENTS OF THE INVENTION

Although the description hereof is detailed and exact to enable those skilled in the art to practice the invention, the physical embodiments herein disclosed merely exemplify the invention which may be embodied in other specific structures. The scope of the invention is defined in the claims appended hereto.

Figure 2:
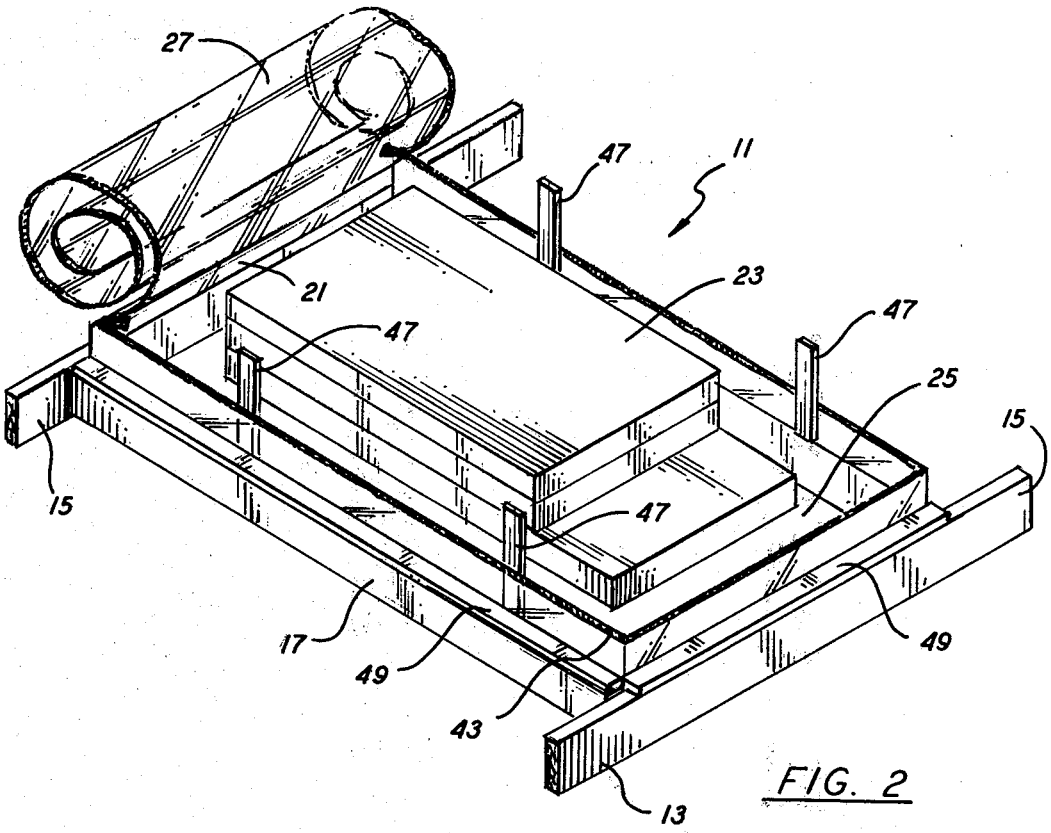
FIG. 2 is a perspective view of the ceiling enclosure shown in FIG. 1 with the enclosure rolled back to permit ingress and egress through the ceiling entrance and with a folded stairway in its stored position.
Figure 1:
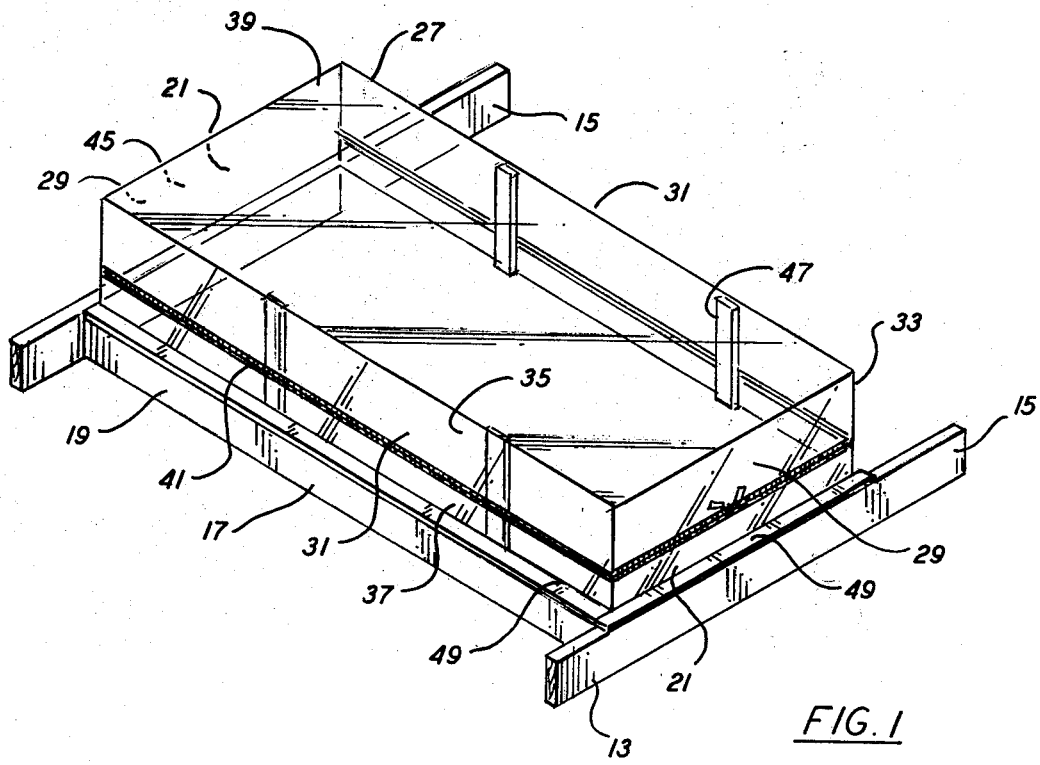
FIG. 1 is a perspective view of the ceiling enclosure in its closed form.

FIG. 1 and FIG. 2 both show an entrance 11 of the type frequently found in a home for purposes of entering the attic crawlspace from the top floor of the house. As is well known, the floor of an attic crawlspace is normally insulated but the crawlspace itself is not heated. An entrance 11 through the ceiling is used since the area is most generally used only infrequently for purposes of storage.

Such an entrance 11 is formed from a frame 13 including the rafters 15 of the building and cross members 17 between the rafters. The rafters 15 and cross members 17 form the entrance 11, usually with a rectangular shape, through the ceiling with two major sides 19 and two minor sides 21. Frequently, but not essentially, such a ceiling entrance uses a folding staircase 23 which, by means of hinges, (not shown) folds downwardly for use and then folds up and over itself for storage. A door 25, also folds downwardly at one end by means of hinges (not shown). The folding staircase 23 rests above the door 25.

An envelope 27 which is preferably flexible is located over the entrance 11. Similarly the envelope 27 is formed from two minor panels 29 and two major panels 31, each of which is vertically oriented and each of which is integrally connected to the other. One of the minor panels 29, namely a slotted minor panel 33, and both major panels 31 are separated into an upper portion 35 and a lower portion 37. A top panel 39 is located in a generally horizontal position and is also integrally connected to both minor panels 29 and both major panels 31. The upper portion 35 and the lower portion 37 are separable from one another along a slot 41 along both major panels 31 and the slotted minor panel 33. This slot 41 is located in the two major panels 39 and the slotted minor panel 33 between the entrance 11 and the top panel 39. The slot 41 is best located close enough to the entrance 11 so that the lower portion 37 of the slotted minor panel 33 and two major panels 31 does not create an obstacle to the use of the entrance 11. A fastening means 43 mounted in the slot 41 is preferably one or two zippers. If one zipper is used it must begin at one of the minor panels 29 which is a solid minor panel 45 and continued around back to the solid minor panel 45. If two zippers are used, as the fastening means 43, they would meet in the center of the slotted minor panel but would each begin at the solid minor panel 45. Two zippers are often necessary due to the length of the slot. When the fastening means 43 is completely open, the upper portion 35 of the preferably flexible envelope 27 can be easily lifted back over the solid minor panel 45 which bends backwardly.

The enclosure can be produced in a kit form and can be easily installed with simple hand tools. The lower edge of the envelope 27 can be secured to the top of the frame 13. Four posts 47, preferable wooden slats cut to the same length, are used to hold the envelope 27 up over the entrance 11 above the folding stairs 23 and to provide a dead air space. The four posts 47 are secured in any normal manner such as screws or nails at their lower end to the frame 13. The four posts 47 are vertically oriented at substantially right angles to the frame 13. The envelope 27 is preferably located outside the four posts 47. The four posts 47 are preferable located between the minor panels 29 and the centerline of the main panels 31 or more specifically about one-quarter the distance along a major panel 31 from their closest minor panel 29 to provide the best distribution of support with the least number of posts 47. Although the four posts 47 are preferably located inside the envelope 27, the posts 47 could also be located outside the envelope 27 and support it by the use of tabs (not shown).

Around the outside of the envelope 27, on top of the lower edge of the envelope 27, there are secured slats 49, preferably by nailing, to the top edge of the frame 13, to seal the lower edge of the envelope 27.

It can be readily seen that with the door 25 to the entrance 11 open, regardless of the form of the door 11, the envelope 27 can be easily opened and rolled back so as to enter the space above the door 25. However, when the envelope 27 is closed, it provides a dead air space above the entrance 11 thereby sealing the entrance 11 and preventing the loss of heat and moisture.

The invention may be embodied in other specific forms without departing from the spirit or essential characteristics thereof. The present embodiments are, therefore, to be considered in all aspects as illustrative and not restrictive. The scope of the invention is indicated by the appended claims rather than the foregoing description and all changes which come within the meaning of range and equivalency of the claims are, therefore, intended to be embraced therein.

I claim:

1. An enclosure for insulating a ceiling entrance from the loss of heat and moisture, said enclosure comprising:

an envelope having a lower edge, said lower edge being secured to said entrance, said envelope being flexible and having a slot through it;

fastening means located in said slot for opening and closing said slot; and means for supporting said envelope above said ceiling entrance.

2. An enclosure for insulating a ceiling entrance according to claim 1 wherein said envelope is generally rectangular in shape.

3. An enclosure for insulating a ceiling entrance according to claim 2 wherein said envelope includes two minor panels and two major panels and a top panel, said two minor panels being vertically oriented and said top panel being generally horizontally oriented.

4. An enclosure for insulating a ceiling entrance according to claim 3 wherein the slot through the envelope is substantially in a horizontal plane along both major panels and one minor panel.

5. An enclosure according to claim 1 wherein said means for supporting said envelope includes a plurality of vertically-oriented posts, each vertically-oriented post having a lower end secured to said ceiling entrance.

6. An enclosure for insulating a ceiling entrance to heat and moisture losses, said ceiling entrance being generally rectangular with two major sides and two minor sides, said enclosure comprising:

an envelope of flexible material having a generally rectangular configuration and including two minor panels and two major panels and a top panel, said envelope being adapted to fit over said ceiling entrance and having a slot in it lying substantially in a horizontal plane along both major panels and one minor panel, said two minor panels and said two major panels being substantially vertically oriented and said top panel being generally horizontally oriented, said two minor panels and said two major panels having a lower edge, said lower edge being secured to said ceiling entrance;

four posts of substantially equal heighth to said two minor and two major vertical panels located within said envelope, each pair of said vertical posts being located along each major side of the ceiling entrance substantially opposite the other pair of said vertical posts, each vertical post being located between the minor panels and the centerline of the major panels;

and four horizontal slats each located about said ceiling entrance and engaging said envelope of flexible material for sealing said envelope to said ceiling entrance.

* * * * *